US007022930B2

(12) United States Patent
Hall et al.

(10) Patent No.: US 7,022,930 B2
(45) Date of Patent: Apr. 4, 2006

(54) SINGLE DIRECTIONAL CABLE ACTUATED EMERGENCY STOP DEVICE

(75) Inventors: Jeffrey S. Hall, Winnebago, IL (US); Mark A. Mantua, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 130 days.

(21) Appl. No.: 10/727,407

(22) Filed: Dec. 4, 2003

(65) Prior Publication Data

US 2005/0121301 A1 Jun. 9, 2005

(51) Int. Cl.
*H01H 15/00* (2006.01)

(52) U.S. Cl. ..... 200/543; 200/61.14; 200/334

(58) Field of Classification Search .. 200/61.14–61.18, 200/543–545, 331, 334, 308
See application file for complete search history.

(56) References Cited

U.S. PATENT DOCUMENTS 4,939,325 A * 7/1990 Wendel et al. ..... 200/552
5,003,135 A * 3/1991 Piccoli ..... 200/52 R
6,365,850 B1 4/2002 Arnold et al. ..... 200/17
6,501,040 B1 12/2002 Hall et al. ..... 200/543
2002/0170811 A1 11/2002 Hall et al. ..... 200/543

FOREIGN PATENT DOCUMENTS

EP 1255262 A2 6/2002

* cited by examiner

*Primary Examiner*—Kyung Lee
(74) *Attorney, Agent, or Firm*—Kermit D. Lopez; Luis M. Ortiz

(57) ABSTRACT

A cable actuated emergency stop system is disclosed, which includes a housing structure within which a single shaft assembly can be maintained for engaging a cable and a single shaft assembly that can be attached to the cable, wherein the single shaft assembly comprises only one shaft that is slideably disposed within the housing structure and movable relative to the housing structure a long a single path in a direction parallel to an axial centerline of the shaft in response to a force exerted by the cable attached to at least one end of the shaft. The system is configured in the context of a single directional cable actuated emergency stop device which includes one operating shaft exiting the housing structure.

13 Claims, 7 Drawing Sheets

SINGLE DIRECTIONAL CABLE ACTUATED EMERGENCY STOP DEVICE

TECHNICAL FIELD

Embodiments are generally related to cable actuated devices. Embodiments are specifically related to directional cable actuated emergency devices usable with manufacturing equipment and the like, and additionally for improving the safety of manufacturing operating equipment.

BACKGROUND OF THE INVENTION

Many types of cable actuated switches are known to those skilled in the art. Cable actuated switches are typically used in applications where an emergency stop capability is required along an extended distance, such as assembly lines. Manufacturers, for example, typically use cable pull safety devices as a low-cost emergency stop device for long conveyor lines or large machines. In certain conveyor system applications it is often necessary to provide a means for operators to actuate the emergency stop condition from many different locations along the conveyor.

Cable activated switches that have been provided generally include a switch support body that has a bore there through. A first switch contact member is generally retained on the body and a second switch contact member is further slidingly retained on the body and insulated therefrom. Clamping means are typically provided for securing the cable passing through the bore. First resilient mechanisms are also provided to bias electrical or manual contact members. During operation, or reaction to a safety hazard, first and second contact members are displaced relative to each other by predetermined axial movement of the cable that passes through the support body. The result is generally the emergency termination of industrial or manufacturing mechanical processes.

Cable controlled electrical safety switch devices have also been provided that include a piston tensioning cable under the action of a spring via a rod and a screw thread for adjusting the tension of the spring and of the cable. A piston groove actuates a push member for the switch. The piston can be angularly adjustable. When the cable is long, a high tension is selected so the groove flank moves away from the push member. Distancing is desirable in such systems in order that any length variations due to heat, which are greater with a long cable, may be prevented from triggering the switch. The clearance between the other flank and the push member is then corrected by rotation of the piston.

Because electrical switches for preventing an accident in a mechanism employing a control cable can generally be included in a casing having a pair of contacts at opposite inner side surfaces thereof and an insulator member having a movable contact, an insulation member may be configured such that it is slideably and axially moved within the casing in connection with tensile force of inner cables. When the inner cables become inoperable because of some problem, the movable contact is touched to the contacts provided on the inner side surfaces of the casing in order to detect the problem or to stop the movement of the mechanism.

U.S. Pat. No. 5,665,947, which issued to Falcon on Sep. 9, 1997, and is owned by the assignee of the present invention, describes a cable switch actuating mechanism, which is provided with a shaft, and a cam structure that slides on the shaft. When the associated cable is pulled to exert an axial force on the shaft, the cam actuator is pushed by the shaft into a deactuating position that moves a switch operator plunger against a plunger of an associated electrical switch. If the cable breaks, the reduction of force on the shaft allows an internal spring to move the shaft against the cam structure and, as a result, move the switch operator into its deactuating position. Appropriate gaps between the opposite ends of the cam structure and associated surfaces of the shaft were provided by design to allow for thermal expansion and contraction of the cable without adverse affects on the mechanism.

U.S. Pat. No. 5,821,488, which issued Oct. 13, 1998, is an improvement over the cable operated switching mechanism described in the '947 patent described above and is also assigned to the assignee of record for the present invention. The improvement is the provision of a latch device associated with a reset plunger which is movable between a normal operating position and a resetting position, wherein the cam structure is moved by the reset plunger to unlock the switch operator when the reset plunger is moved to the resetting position. The positive locking method of the cable operated switching mechanism latches a cam structure in place after the cable is pulled by an operator and does not permit the cam structure to return to its normal operating position until manual intervention is used to push a reset plunger. The cable operated switching mechanism provided a positive stop by incorporating a tab on a latching device, which is associated with the reset plunger and moves with it when a reset button is pushed.

The tab of the latching device slides along a first surface of the cam structure until the cable is pulled to activate the mechanism. Then, under the influence of a spring, the latching device moves upward to cause the tab to move into a blocking position relative to a second surface of the cam structure. The tab prevents the cam structure from moving from its actuated position to its normal operating position until a reset button is pushed. This mechanism overcomes a possible problem wherein a loosely assembled cable, with too much slack, could otherwise allow a switch to be activated by the mechanism, following deactivation by an operator pulling the cable.

U.S. Pat. No. 6,501,040, which issued on Dec. 31, 2003 and is owned by the assignee of the present invention describes a dual directional cable actuated emergency stop device is provided having two shaft assemblies attachable to respective cables spanning along an industrial and/or manufacturing operation. The first shaft assembly is slideably disposed within a housing structure and movable relative to the housing structure along a first path in a direction parallel to an axial centerline of the shaft in response to a force exerted by a cable attached to an end of the first shaft. The second shaft assembly is slideably disposed within the housing structure and movable relative to the housing structure along a second path in a direction parallel to an axial centerline of the shaft, and opposite movement of the first shaft, in response to a force exerted by a cable attached to an end of the first shaft.

A switch operator movable along a second path between a first position and a second position is responsive to movement of the first or second shaft assemblies and is also responsive to a mechanism for locking the switch operator in a second position after the switch operator moves into a second position. At least one electrical switch associated with the device can be actuated when the switch operator is in the second position and deactuated when the switch operator is in the first position. Windows formed on the device housing cover allow a user to monitor tension of first or second cables attached to respective first and second shaft assemblies, based on the position of a cam associated with each shaft assembly.

When long cable lengths are used in association with a cable actuated switch, changes in temperature can activate or deactivate the switch because of the resultant changes in the length of the cable as a result of the cable's thermal coefficient of expansion. With regard to the expansion or contraction of the cable as a result of temperature change, it is much more common for most cables to experience high temperatures during extended use than when the cable was initially installed. In some environments, opposite extreme conditions may exists (e.g., lower temperatures than experienced during initial installation). This occurs because many applications of cable-actuated switches are used in circumstances, such as warehouses, where there may be large variation in temperature that affect the cables characteristics. Furthermore, heating or air conditioning may or may not be provided for winter or summer conditions in such environments. As a result, heating systems are able to maintain the apparatus at normal operating temperatures during winter months, but no air conditioning systems are provided to maintain the apparatus at normal operating temperatures during summer months. As a result, the cables can expand beyond their normal lengths during summer months.

Rather than provide numerous emergency stop switches at multiple locations along the equipment, it is sometimes deemed economically advantageous to provide a single switch that can be actuated by pulling a cable that may extend along, for example, a conveyor system from the switch to a remote location. Although the majority of cable pull devices are single direction units capable of spans up to around 200 feet, some dual directional units do exist, which in effect double the span to around 400 feet. With such long spans of cabling, malfunctions and/or false activations can be prevalent. For example, teasing of the device is found where electrical trip happens prior to mechanical trip.

In a teased condition, the normally closed contacts would be open, but the normally open contacts would remain open. The normally closed contacts typically shut down the machine, and the normally open contacts typically signal (e.g., light, etc.) that the device was tripped. Therefore, if the device is teased, the machine could shut down without any indication of the source. On long conveyor lines or large machines, this situation is costly and frustrating.

Another problem with such prior art devices is the difficulty associated with their set up. For example, to reset (e.g., place in run mode) a cable pull device, the cable must be set to a proper tension. Determining proper cable tension for accurate operation can be difficult. It may also be difficult to determine if the system or device is in the proper run or off state.

It would be advantageous to remedy the foregoing and other deficiencies in the prior art and to facilitate the safe employment of manufacturing equipment, or the like. There is a continued need for improvement in safety mechanisms used, for example, with high-speed industrial equipment that is subject to forces that can cause an interruption in the proper operation of the equipment and can result in damage to persons and/or the equipment if the operation is not terminated in a safe manner. Accordingly, embodiments are described and presented as a novel means to address the shortcomings of the prior art.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide for an improved cable actuated device.

It is another aspect of the present invention to provide for a single directional cable actuated emergency device that can be utilized with manufacturing equipment and the like for improving the safety of operating the equipment.

The aforementioned aspects of the invention and other objectives and advantages can now be achieved as described herein. A cable actuated emergency stop system is disclosed, which includes a housing structure within which a single shaft assembly can be maintained for engaging a cable and a single shaft assembly that can be attached to the cable, wherein the single shaft assembly comprises only one shaft that is slideably disposed within the housing structure and movable relative to the housing structure along a single path in a direction parallel to an axial centerline of the shaft in response to a force exerted by the cable attached to at least one end of the shaft.

The system is configured in the context of a single directional cable actuated emergency stop device which includes one operating shaft exiting the housing structure. Such a device is configured in a user friendly and intuitive manner, because the device includes window on a cover of the housing structure through which a user can peer in order to determine if the actuating cable has attained the proper tension or it the cable requires tightening or loosening. Diagnostics are provided by a mechanical trip indicator, so that the user can easily and visually determine if the single directional cable actuated emergency stop device is tripped or in a "run" position.

The single directional cable actuated emergency stop device described herein with respect to varying embodiments provides pulled cable and slacken/broken cable detection capabilities. The single directional cable actuated emergency stop device possesses a "snap-action" mechanism that does not allow the electrical switch mechanism to be teased (i.e., electrical trip prior to mechanical trip) in either the pulled or slacked/broken cable. The single directional cable actuated emergency stop device can latch in both the pulled or slackened/broken cable, and thereafter remains latched until a reset knob or other reset device is rotated.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment of the present invention and are not intended to limit the scope of the invention.

Figure 1:
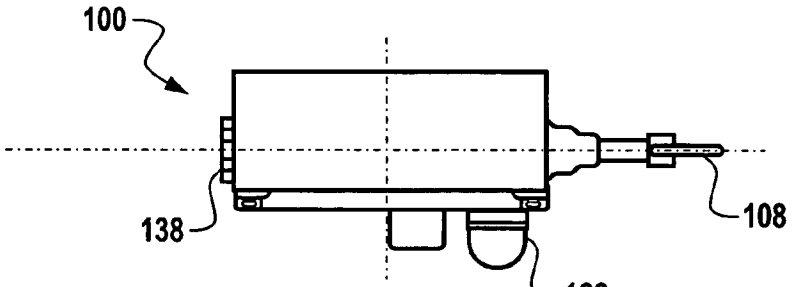
FIG. 1 illustrates a top view of a single directional cable actuated emergency stop device in accordance with a preferred embodiment of the present invention.
Figure 2:
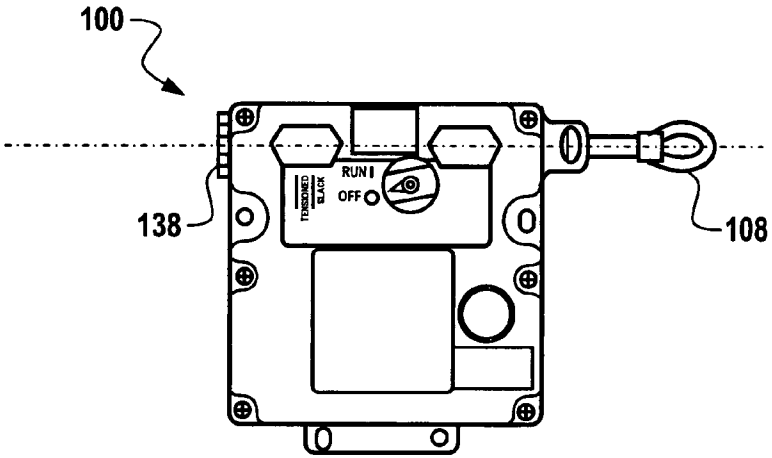
FIG. 2 illustrates a front plan view of the single directional cable actuated emergency stop device depicted in FIG. 1 in accordance with a preferred embodiment of the present invention.
Figure 3:
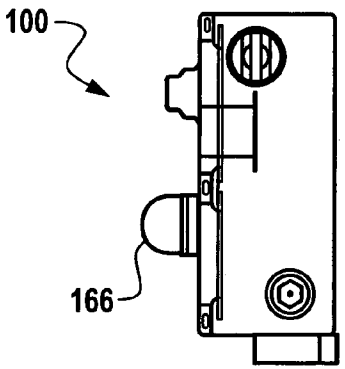
FIG. 3 illustrates an opposing side view of the directional cable actuated emergency stop device depicted in FIG. 1 in accordance with a preferred embodiment of the present invention.
Figure 4:
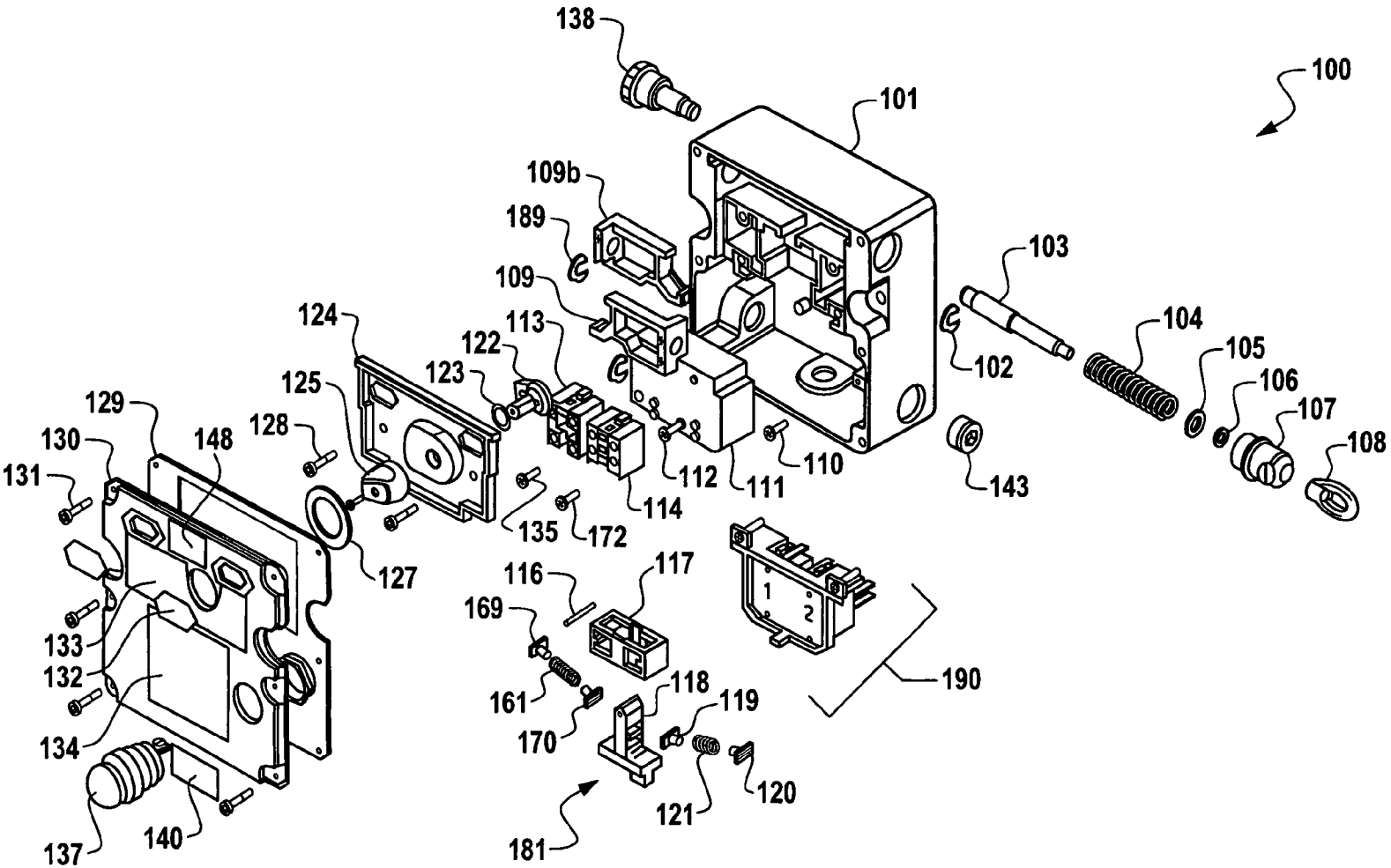
FIG. 4 illustrates a perspective and exploded view of the single directional cable actuated emergency stop device depicted in FIGS. 1 to 3 in accordance with a preferred embodiment of the present invention.

FIG. 1 illustrates a top view of a single directional cable actuated emergency stop device 100 in accordance with a preferred embodiment of the present invention. FIG. 2 illustrates a front plan view of the directional cable actuated emergency stop device 100 depicted in FIG. 1 in accordance with a preferred embodiment of the present invention. FIG. 3 illustrates an opposing side view of the single directional cable actuated emergency stop device 100 depicted in FIG. 1 in accordance with a preferred embodiment of the present invention. FIG. 4 illustrates a perspective and exploded view of the directional cable actuated emergency stop device 100 depicted in FIGS. 1 to 4 in accordance with a preferred embodiment of the present invention.

Figure 6:
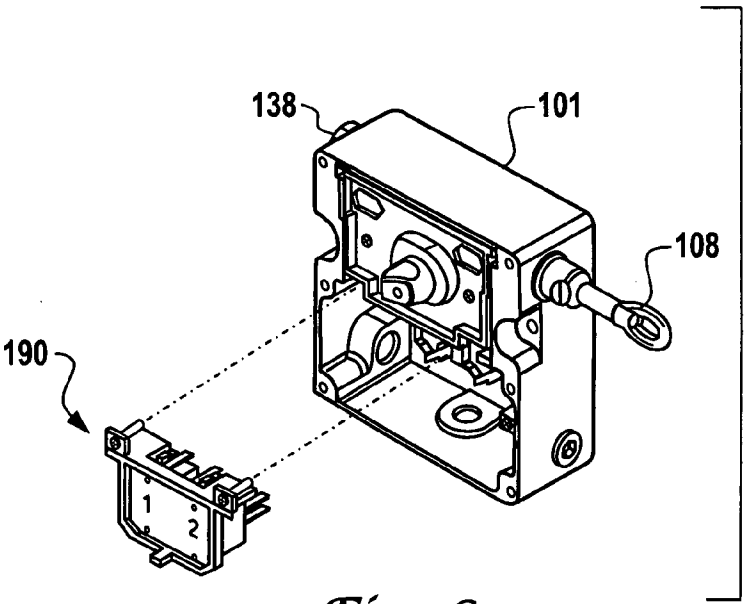
FIG. 6 illustrates an angular perspective view of a single directional cable actuated emergency stop device depicted in FIGS. 1 to 4 in accordance with a preferred embodiment of the present invention.
Figure 5:
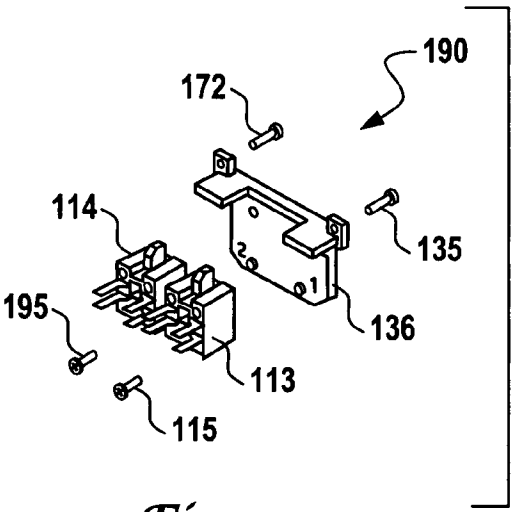
FIG. 5 illustrates an angular view of a removable contact bock assembly, which can be implemented in accordance with the directional cable actuated emergency stop device depicted in FIGS. 1 to 4 in accordance with a preferred embodiment of the present invention.
Figure 7:
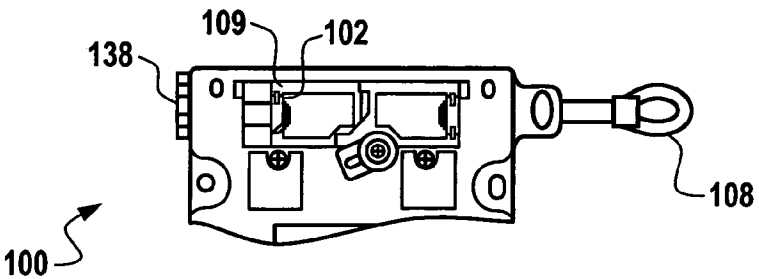
FIG. 7 illustrates a partial cut-away side view of the single directional cable actuated emergency stop device depicted in FIGS. 1 to 4 in accordance with a preferred embodiment of the present invention.

FIG. 5 illustrates an angular view of a removable contact bock assembly 190, which can be implemented in accordance with the single directional cable actuated emergency stop device 100 depicted in FIGS. 1 to 4 in accordance with a preferred embodiment of the present invention. FIG. 6 illustrates an angular perspective view of the directional cable actuated emergency stop device 100 depicted in FIGS. 1 to 4 in accordance with a preferred embodiment of the present invention. FIG. 7 illustrates a partial cutaway side view of the single directional cable actuated emergency stop device 100 depicted in FIGS. 1 to 4 in accordance with a preferred embodiment of the present invention. Note that in FIGS. 1 to 7, identical or similar parts or components are generally indicated by identical reference numerals.

An operating shaft 103 and a return spring 104 can be retained to a housing 101 using a threaded bushing 107. Note that the housing 101 can be formed from as a die cast housing from a material such as zinc. Housing 101 can therefore be configured as zinc die cast housing. Housing 101 can also be formed of other materials such as a strong plastic, depending upon the design needs. A plastic cam 109 can be inserted onto the operating shaft 103 and retained by one or more retaining rings 102 and 189. The plastic cam 109 can be fixed to an end of the shaft(s) (e.g., shaft 103) and restrained from rotating by either the housing 101 or an internal cover 124 and a spacer 109*b*, which is actually another plastic cam. Therefore, the operating shaft 103 can rotate without affecting the cam 109.

A section of the cam 109 can be visible through a lens 132 in the cover 130 to provide a tensioning indication. Lens 132 generally is located by a flexible nameplate 134 configured on cover 130. One or more screws such as, for example, screw 131, can retain the cover 130 to housing 101. A seal gasket 129 is located between cover 130 and housing 101. Located between the cover 124 and cover 130 is a seal ring 127. Screws 128 retain the cover 124 to the housing 101. Switches 114, 113 can be are retained by screw(s) 115. Device 100 also includes a seal 123 between the cam 122 and cover 124. A bracket 111 also couples with housing 101. Bracket 111 is connected with housing 101 via screw(s) 112.

A Pipe fitting plug 143 can be installed into unused conduit holes on housing 101. Note that return spring 104 is located generally between retaining ring 102 and flat washer 105, which in turn engages a seal ring 106. Seal ring 106 contacts shouldered bushing 107 and the actuating rod and operating shaft 103. Eye nut 108 can be attached to the operating shaft 103 as a means for attaching the actuating cable. A general bushing 138 can also engage housing 101.

The return spring 104 generally applies a force to the cam 109 and shaft 103, thereby forcing cam 109 and shaft 103 towards the center of device 100. If the actuating cable becomes loose, the return spring 104 applies a force to the cam 109 moving the cam position, which can be viewed through the cover 130, indicating that the actuating cable requires adjustment. If the actuating cable is too tight (i.e., during set up or due to temperature variations), the cam position, which can be viewed through cover 130, moves thereby indicating that the actuating cable requires adjustment.

The cam profile actuates a plunger 118 that in turn can operate basic switches 113 and 114. A "snap action" can be obtained through the implementation of a single plunger mechanism 181, which is generally configured as an over-center type of mechanism comprising a plunger 118, a carrier 117, and a set of compression springs 121 and 161 respectively assembled to pivot shafts 119 and 120 and 169 and 170. Pivot shafts 119 and 120 and pivot shafts 169 and 170 are respectively located at ends of springs 161 and 121. An end of such pivot shafts pivots on plunger 118. The opposite ends of the pivot shafts pivot on the carrier 117. The plunger mechanism 181 sits within a gap or pocket within housing 101 and is retained by the internal cover 124.

Plunger 118 can be configured to include a pin 116 that allows a fork-shaped cam 122 to be attached to a reset knob 125 on the cover 124 in order to reset the cam 122. Reset knob 125 also can function as mechanical indication of a "trip". When the plunger 118 is "up", the rest knob 125 is in a position that indicates "run" by pointing to the word "RUN" on cover label 133 on cover 130. When the plunger 118 is "down", the rest knob 125 can be rotated to a position that indicates a "trip" by pointing to the word "OFF" on the cover label 133 on cover 130. The reset knob 125 is attached to the internal cover 124 subassembly that remains attached to of the housing 101, so that the cover 130 is assembled to housing 101 without lining up any other components.

When the operating shaft 103 is at a proper tension, the plunger 118 can be moved into a "run" position by rotating the reset knob 125. The plunger 118 can be maintained in the "run" position by the pivot springs 161 and 121 in association with respective pivot shafts 169, 170 and 119, 120. When the operating shaft 103 is pulled or pushed into the broken cable, the cam 109 moves the plunger 118 downward. As cam 109 and plunger 118 moves, the pivot points of the pivot springs 121 and 161 on the plunger 118 also move. After the pivot point of plunger 118 passes the pivot point on the carrier 117, the resulting spring force pushes the carrier 117 upward and plunger 118 downward, independent of shaft movement thereof. Plunger 118 actuates the switches 113 and 114. The use of the carrier 117 improves "snap-over" by ensuring that the springs 121 and 161 are always at an angle thereby producing vertical forces at the plunger 118. The plunger 118 can thus be maintained in this final position by the two pivot springs 121 and 161.

Note that in FIG. 5, a removable contact block 190 is depicted, including a plurality of screws, 172, and 135 thereof that can engage a plastic bracket 136 to the housing 101. Switches 113 and 114 are also shown in FIG. 5, in addition to thread forming screws 115 and 195. Nut 108 is also shown in FIG. 6, in addition to various views of FIGS. 1–5. Housing 101 is co-located with nut 108. Note that in a single directional implementation as indicated herein, only one such nut is required. The removable contact block 190 depicted in FIG. 5 is also shown in FIG. 6 prior to assembly with housing 101.

As indicated in FIG. 7, nut 108 can be located generally at the "right" actuator portion of device 100. In an alternative embodiment, nut 108 can be located at the left actuator portion of device 100. The placement of nut 108 is simply a design choice. Nut 108 is also indicated in more detail FIGS. 1, 2, and 3. Bushing 138 is shown in FIG. 7 generally located at the "left" actuator portion of device 100. In an alternative embodiment, bushing 138 can be located at the right actuator portion of device 100. Again, the placement of features such as bushing 138 is a design preference.

For a single direction right implementation, shaft 103, spring 104, washer 105, seal 106, bushing 107, cam 109, and nut 108 can be installed to the right of bushing 138. For single directional left implementation, shaft 103, spring 104, washer 105, seal 106, bushing 107, cam 109, and nut 108 can be installed at the left and bushing 138 and cam 109 (i.e., used as a spacer) can be installed on the right. A pilot light 137 is also depicted generally in FIGS. 1 to 4.

Figure 9:
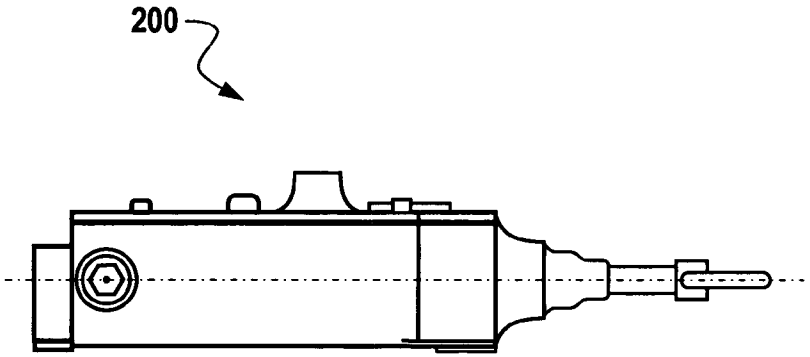
FIG. 9 illustrates a side plan view of the single directional cable actuated emergency stop device depicted in FIG. 8, in accordance with an alternative embodiment of the present invention.
Figure 8:
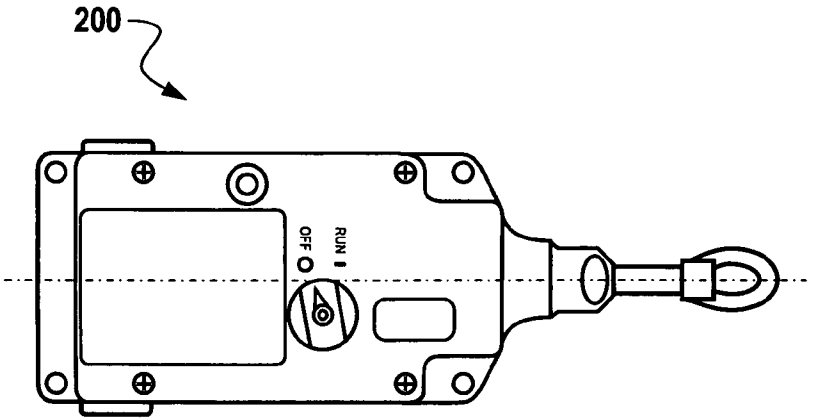
FIG. 8 illustrates a top plan view of a single directional cable actuated emergency stop device, which can be implemented in accordance with an alternative embodiment of the present invention.
Figure 10:
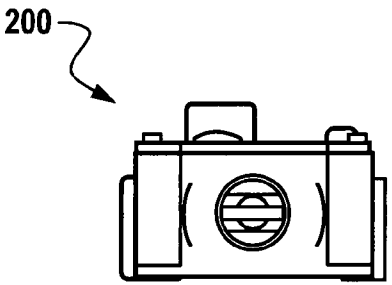
FIG. 10 illustrates a side plan view of the single directional cable actuated emergency stop device depicted in FIGS. 8 and 10, in accordance with an alternative embodiment of the present invention.
Figure 11:
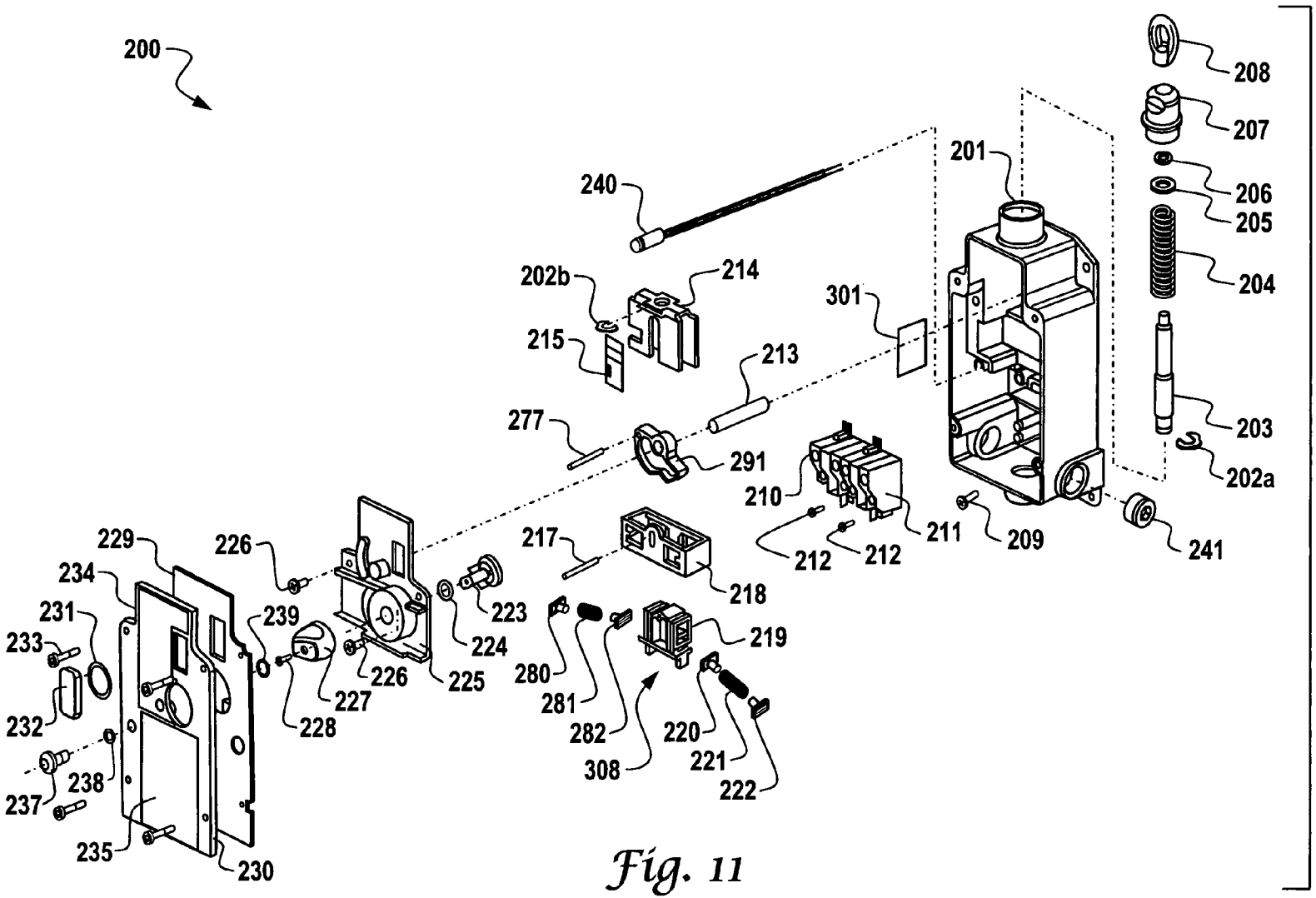
FIG. 11 illustrates an exploded perspective view of the single directional cable actuated emergency stop device depicted in FIGS. 9 to 11, in accordance with an alternative embodiment of the present invention.

FIG. 8 illustrates a front plan view of a single directional cable actuated emergency stop device 200, which can be implemented in accordance with an alternative embodiment of the present invention. FIG. 9 illustrates a side plan view of the single directional cable actuated emergency stop device 200 depicted in FIG. 8, in accordance with an alternative embodiment of the present invention. FIG. 10 illustrates a side plan view of the single directional cable actuated emergency stop device 200 depicted in FIGS. 8 and 9, in accordance with an alternative embodiment of the present invention. FIG. 11 illustrates an exploded perspective view of the single directional cable actuated emergency stop device 200 depicted in FIGS. 8 to 10, in accordance with an alternative embodiment of the present invention. Note that in FIGS. 8 to 11, identical or similar parts are indicated by identical reference numerals.

An operating shaft 203 (i.e., an actuating rod or actuator) and a return spring 204 can be retained to a zinc die cast housing 201 utilizing a threaded shouldered bushing 207. Retaining rings 202*a* and 202*b* can be utilized to assist in maintaining operating shaft 203. A flat washer 205 is located between spring 204 and a seal ring 206. Seal ring 206 in turn is located between the flat washer 205 and the shouldered bushing 207. A nut 208 is thereafter connected to the operating shaft 203.

A metal plunger 214 can be inserted onto the operating shaft 203 and retaining by retaining ring 202. The metal plunger 214 is generally fixed to the end of the shafts and is restrained from rotation by housing 201 and an internal cover 225. Therefore, the operating shaft 203 can rotate without affecting the plunger 214. The metal plunger 214 generally contacts the pin 277 to rotate a cam 291 that rotates about a shaft pin 213. A label 215 on the metal plunger 214 is visible through a lens 232 in the cover 230 to provide a tensioning indication. Cover 230 can be formed from metal or plastic depending upon design needs and restraints. The return spring 204 applies a force to the operating shaft 203 and the metal plunger 214, thereby rotating the cam 291 clockwise.

If the actuating cable becomes loose, the return spring 204 applies a force to operating shaft 203, moving the metal plunger 214, which can be viewed through cover 230, indicating that the actuating cable requires adjustment. If the actuating cable or operating shaft 203 is too tight, the metal plunger 214 position, which can be viewed through cover 230, moves, indicating that the actuating cable or operating shaft 203 requires adjustment.

The cam profile actuates a plastic plunger 219 that in turn operates the basic switches 210 and 211. The "snap action" is obtained by a single plunger mechanism 308, which functions as snap-action and over-center type of mechanism. Plunger mechanism 308 generally includes a plunger 219, a carrier 218 and set of compression springs 221 and 281 which are respectively assembled to pivot shafts 220, 222 and 280, 282. One end of the pivot shafts pivot on the plunger, while the opposite end of the pivot shafts can pivot on the carrier 218. The plunger mechanism 308 can sit within a pocked or cavity formed from and surrounded by housing 201 and also retained by internal cover 225.

Plastic plunger 219 can also include a pin 217 that allows a fork-shaped cam 223 to be attached to a rest knob 227 on the cover 225 to reset the plunger mechanism 308. The reset knob 227 can also function as a mechanical indication of a "trip". When the plastic plunger 219 is "up", the reset knob 227 is in a position that indicates "run" by pointing to the word "RUN" on the cover label 234. When the plastic plunger 219 is "down", the reset knob 227 can be rotated to a position that indicates a "trip" by pointing to the word "OFF" on the cover label 234. The reset knob 227 is generally located on a subassembly of housing 201, so that the cover 230 can be easily assembled to housing 201 without aligning other components.

A cable (not shown in FIGS. 8–11) can be attached to operating shaft 203 via nut 208. The cable can be tightened until the label 215 on the metal plunger 214 is centered on the cover lens 232. Note that a seal 231 is located between lens 232 and cover 230. One or more screws 233 can be utilized to maintain cover 230 to housing 201. Additionally, a seal ring 238 can be connected to a light pipe 237 at plate or cover 230. A flexible nameplate 235 and nameplate 234 can be assembled to the sheet metal cover 230. Note that cover 230 can be formed from material other than sheet metal, such as plastic.

Cover 230 is located next to a gasket seal 229. A push-on nut 239 is assembled to the light pipe 237. A screw 228 connects the reset knob 227 to the cam 223. Thread cutting screws 226 can be utilized to assemble the cover 225 to the housing 201. A seal ring 224 also engages cover 225 at cam 223. The cam 291 rotates about pin 213. Pin 213 is retained by the housing 201 and cover 225. A label 301 can also be incorporated on or into housing 201 to provide information about parts within housing 201. An additional pin 277 can be inserted through cam 291. A retaining ring 202*a* and 202*b* connects the plunger 214 to the shaft 203. A pilot light 240 can also be assembled into housing 201. An assembled washer screw 209 can be connected to the housing 201 for the end user to make an electrical termination to earth ground. Screws 212 retain switches 211, 210. A fitting 241 also connects to housing 201.

At proper tension, the plastic plunger 219 can be moved into the "run" position by rotating the reset knob 227. The plastic plunger can be maintained in the "run" position by the pivot springs 221 and 281. When the shaft 203 is pulled or pushed into the broken cable, the metal plunger 214 rotates that cam 291, which moves the plastic plunger 219 down. As the cam 291 and plastic plunger 219 moves, the pivot point of the pivot springs on the plunger 219 moves.

After the pivot point of the plastic plunger 219 passes the pivot point on the carrier 218, the spring force pushes the carrier 218 "up" and the plastic plunger 219 "down" independent of the movement of shaft 203. The plastic plunger 219 can then actuate the switches 210, 211. The use of the carrier 218 improves "snap over" by ensuring that the springs 221 and 281 are always at positioned at an angle, thereby producing vertical forces at the plastic plunger 219. The plastic plunger 219 is maintained in the final position by the two pivot springs 221 and 281. The two plungers 214 and 219 do not have to be metal and plastic, but can be configured using other materials.

Figure 12:
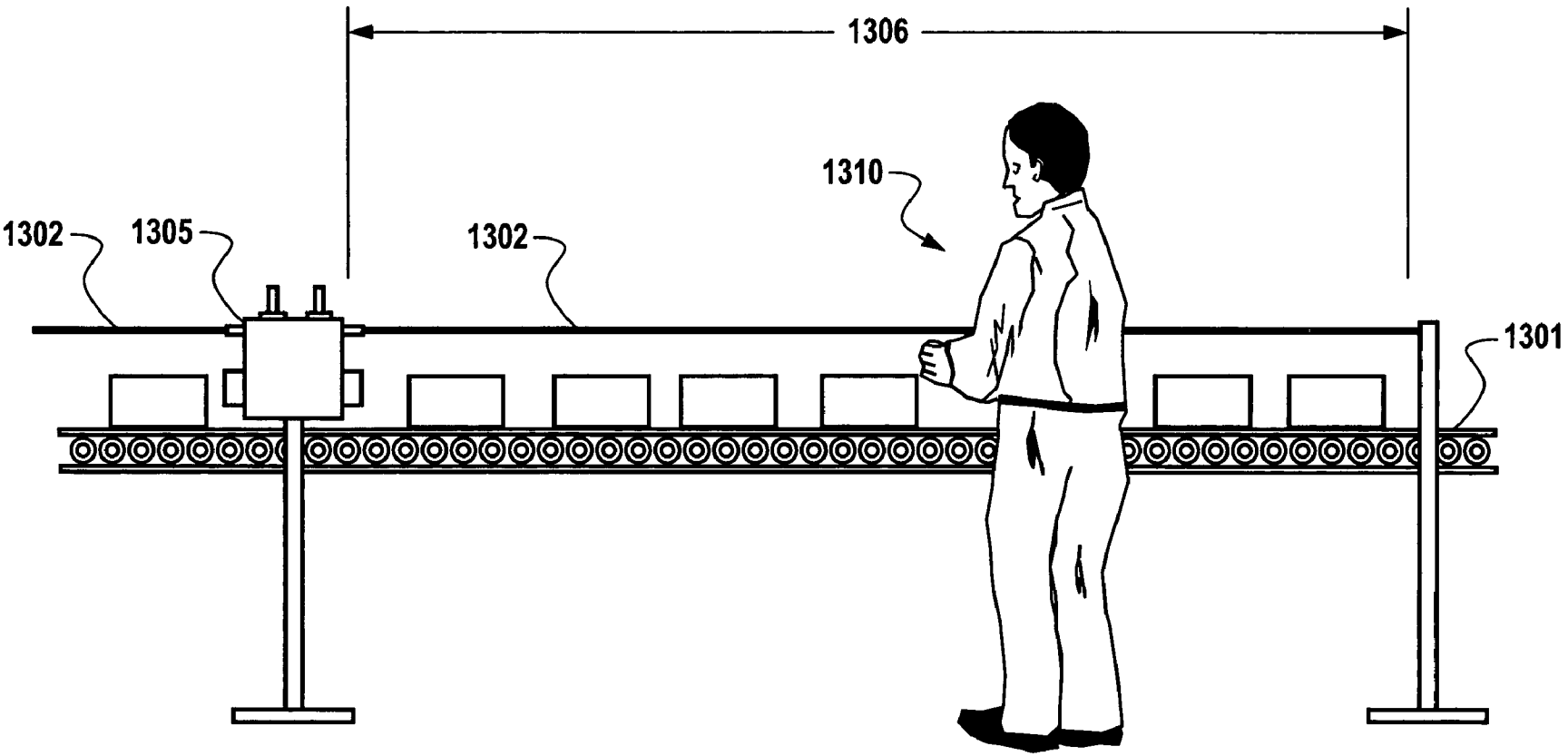
Fig. 12 (Prior Art)
FIG. 12 illustrates an environment wherein a directional cable actuated emergency stop device can be utilized.

Referring to FIG. 12, an illustrated example is provided of a manufacturing environment wherein the device described herein s can be implemented. The configuration of FIG. 12 depicts a conveyor system 1301 which can be utilized in an assembly line. Although system 1301 is labeled as "prior art" in FIG. 12, but it can be appreciated that system 1301 can be modified and adapted for use with one or more embodiments of the present invention. The device 1305 can be secured in its placement between a cable 1302. The cable 1302 is generally within the reach of the operator 1310 so that an emergency may be indicated by the manual placement of tension on the cables. Tension can occur purposely where the operator had manually placed pressure on the cable or where the operator had become placed dangerously into interference with the conveyance system.

The benefit of using a single directional cable actuated emergency device as described herein with respect to embodiments is apparent given the present teachings and illustration, especially for lengthy industrial application such as the illustrated conveyor line 1301 of FIG. 12. For example, the span of cable indicated by reference 1306 in FIG. 12 can easily meet all manufacturing and industrial requirements with spans reaching 100 ft or more. It should also be appreciated given the teachings herein, that other members extending from the device may be used to interrupt operation. For example, string, rope, wire, threaded screws or fasteners, elongated members such as poles (plastic, metal, wood), or a combination of any of the above materials including mesh or net material. These materials are known to be accessible to operators at production sites and can be used to interfere with operations when actuated by physical disturbance by personnel. Therefore, the term "cable" is broadly defined herein as including all of the aforementioned examples.

Figure 13:
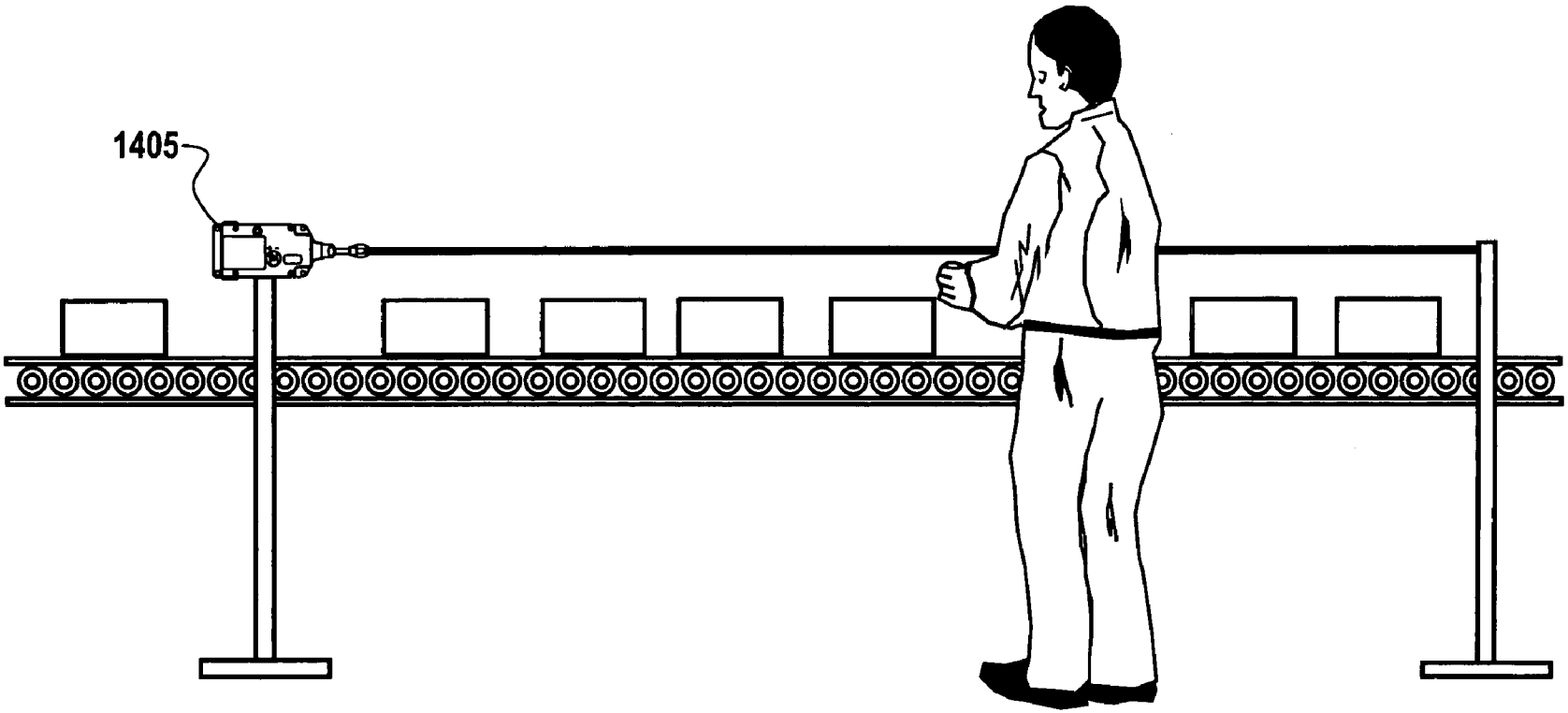
FIG. 13 illustrates an environment wherein a single cable device, similar to those taught in the prior art, is used.

Referring to FIG. 13, an example illustration of the same environment is shown wherein only a single action device 1405, as currently provided in the art, is utilized.

The embodiment and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

The invention claimed is:

1. A cable actuated emergency stop system, comprising:

a housing structure within which a single shaft assembly can be maintained for engaging at least one cable;

at least one electrical switching mechanism maintained within said housing structure wherein said at least one electrical switching mechanism comprises at least one switch;

a snap-action mechanism that prevents said at least one electrical switching mechanism from being teased; and a single shaft assembly that can be attached to said at least one cable, wherein said single shaft assembly comprises only one shaft that is slideably disposed within said housing structure and movable relative to said housing structure along a single path in a direction parallel to an axial centerline of said shaft in response to a force exerted by said at least one cable attached to at least one end of said shaft.

2. The system of claim 1 wherein said housing structure comprises at least one window for viewing if at least one cable is in proper tension within said housing structure.

3. The system of claim 1 further comprising a mechanical trip indicator located within said housing structure, wherein said mechanical trip indicator permits a user to detect if said single shaft assembly has been tripped or is in an active position thereof.

4. The system of claim 1 wherein said single shaft assembly further comprises a return spring which engages said shaft, such that said shaft and said return spring are retained within said housing structure utilizing a threaded bushing.

5. The system of claim 1 wherein said single shaft assembly further comprises at least one retaining ring for retaining a cam inserted into said shaft, such that said cam is fixed to an end of said shaft and restrained from rotating.

6. The system of claim 1 further comprising a plunger mechanism comprising at least one plunger, a carrier and a plurality of compression springs assembled to respective pivot shafts thereof, such that opposite ends of said respective pivot shafts pivot on said carrier.

7. The system of claim 6 wherein said plurality of compression springs are positioned at angle to said at least one plunger to promote a snap-over action thereof.

8. A cable actuated emergency stop system comprising:

a housing structure within which a single shaft assembly can be maintained for engaging at least one cable;

a single shaft assembly that can be attached to said at least one cable, wherein said single shaft assembly comprises only one shaft that is slideably disposed within said housing structure and movable relative to said housing structure along a single path in a direction parallel to an axial centerline of said shaft in response to a force exerted by said at least one cable attached to at least one end of said shaft; and a plunger mechanism comprising at least one plunger, a carrier and a plurality of compression springs assembled to respective pivot shafts thereof, such that opposite ends of said respective pivot shafts pivot on said carrier.

9. The system of claim 8 wherein said housing structure comprises at least one window for viewing if at least one cable is in proper tension within said housing structure.

10. The system of claim 8 further comprising a mechanical trip indicator located within said housing structure, wherein said mechanical trip indicator permits a user to detect if said single shaft assembly has been tripped or is in an active position thereof.

11. The system of claim 8 wherein said single shaft assembly further comprises a return spring which engages said shaft, such that said shaft and said return spring are retained within said housing structure utilizing a threaded bushing.

12. The system of claim 8 wherein said single shaft assembly further comprises at least one retaining ring for retaining a cam inserted into said shaft, such that said cam is fixed to an end of said shaft and restrained from rotating.

13. The system of claim 8 wherein said plurality of compression springs are positioned at angle to said at least one plunger to promote a snap-over action thereof.

* * * * *